US005942086A

United States Patent [19]

Owen

[11] Patent Number: 5,942,086

[45] Date of Patent: Aug. 24, 1999

[54] APPLICATION OF MATERIAL TO A SUBSTRATE

[75] Inventor: David Malcolm Owen, Northwich, United Kingdom

[73] Assignee: Philip Chem-Solv, Inc., Detroit, Mich.

[21] Appl. No.: 08/750,937

[22] PCT Filed: Aug. 16, 1995

[86] PCT No.: PCT/GB95/01935

§ 371 Date: Feb. 13, 1997

§ 102(e) Date: Feb. 13, 1997

[87] PCT Pub. No.: WO96/05373

PCT Pub. Date: Feb. 22, 1996

[30] Foreign Application Priority Data

Aug. 16, 1994 [GB] United Kingdom ..... 9416520
Sep. 24, 1994 [GB] United Kingdom ..... 9419323

[51] Int. Cl.[6] ..... D21H 23/76; D21H 17/28; D21H 17/37; D21H 17/44

[52] U.S. Cl. ..... 162/135; 162/183; 162/168.3; 162/166; 162/175; 427/391

[58] Field of Search ..... 162/135, 183, 162/168.3, 168.1, 168.2, 166, 175, 178, 164.6; 427/391, 388.3, 388.4, 389, 389.7, 389.8, 389.9, 392, 393, 394

[56] References Cited

U.S. PATENT DOCUMENTS

| | | | |
|---|---|---|---|
| 3,180,787 | 4/1965 | Adams | 162/163 |
| 3,264,174 | 8/1966 | Aitken et al. | 162/175 |
| 3,459,632 | 8/1969 | Caldwell et al. | 162/175 |
| 4,094,736 | 6/1978 | Malden | 162/175 |
| 4,272,297 | 6/1981 | Brooks et al. | 106/306 |
| 4,501,641 | 2/1985 | Hirakawa et al. | 162/164.3 |
| 4,643,801 | 2/1987 | Johnson | 162/164.1 |
| 4,820,582 | 4/1989 | Merz et al. | 428/328 |
| 4,925,530 | 5/1990 | Sinclair et al. | 162/164.1 |
| 4,961,825 | 10/1990 | Andersson et al. | 162/175 |
| 5,098,520 | 3/1992 | Begala | 162/168.1 |
| 5,104,487 | 4/1992 | Taggart et al. | 162/168.3 |
| 5,126,014 | 6/1992 | Chung | 162/164.6 |
| 5,129,989 | 7/1992 | Gosset et al. | 162/147 |
| 5,250,153 | 10/1993 | Izard et al. | 162/152 |
| 5,338,406 | 8/1994 | Smith | 162/168.2 |
| 5,792,317 | 8/1998 | Taylor et al. | 162/175 |

FOREIGN PATENT DOCUMENTS

| | | |
|---|---|---|
| 0041056A1 | 12/1981 | European Pat. Off. . |
| 0080986A2 | 6/1983 | European Pat. Off. . |
| 0227465A1 | 7/1987 | European Pat. Off. . |
| 0227465 B1 | 6/1990 | European Pat. Off. . |
| 0548960A1 | 6/1993 | European Pat. Off. . |
| 1055470 | 12/1957 | Germany . |
| 2292394 | 2/1996 | United Kingdom . |

OTHER PUBLICATIONS

Koethe et al., "Polyelectrolyte interactions with papermaking fibers: the mechanism of surface–charge decay," Tappi Journal, vol. 76, No. 12, Dec. 1993.
Boardman, "Some practical observations on the use of cationic agents in the control of interfering substances," Tappi Journal, vol. 76, No. 12, Dec. 1993.
Abstract 61263796; Nov. 21, 1986; Japan.
Abstract 58031199; Feb. 23, 1983; Japan.
Advisory Search Report to United Kingdom Patent Office.
PCT International Preliminary Examination Report.
TAPPI—vol. 60, No. 12, Dec. 1977; pp. 148–149; Carr, M.E. et al "A Polsat Complex for Wet–end Addition".

*Primary Examiner*—Stanley S. Silverman
*Assistant Examiner*—Jose A. Fortuna
*Attorney, Agent, or Firm*—Sidley & Austin

[57] ABSTRACT

The invention relates to a process of applying a polyhydroxy high molecular weight polymer or like material to a substrate, comprising adding to a solution of such material in anionic form a flocculent of oppositely charged form in order to insolubilise such material, and thereafter applying such insolubilised material to said substrate. The invention has particular application in respect of production of paper by adding to the slurry supplied in paper production of an anionic starch and a cationic flocculent in predetermined amounts. The cationic polymer is preferably added prior to addition of the anionic starch. The cationic polymer preferably has a molecular weight of 150,000 or more and the anionic starch is preferably added in an amount of from 75% to 125% of the reaction ratio amount. Preferably, the cationic polymer flocculent is added in an amount of 0.5 kg or more per 1,000 kg of paper substrate and the anionic starch showing an amount of 2 kg or more per 1,000 kg of paper substrate.

27 Claims, 6 Drawing Sheets

Polymer Charge – 60% – Structured Flocculant
Furnish – Unbeaten Virgin
Reaction Ratio – 4:1
pH – Neutral Polymer Charge – 60% – Structured Flocculant
Furnish Unbeaten Virgin
Reaction Ratio 4:1
pH – Neutral Polymer Charge 60% – Structured Flocculant
Reaction Ratio 5.3:1
pH – Neutral Polymer Charge 40% – Linear Flocculant pH – Neutral
Reaction Ratio 4:1

Polymer Charge 60% – Structured Flocculant
Reaction Ratio = 3.3:1
Starch – Oxidised cut in molecular weight Polymer Charge 60% – Structured Flocculant pH – Neutral
Furnished Recycled KLS (OCC)
Reaction Ratio 230:1

Polymer Charge – 100% Coagulant H. Mol. Weight pH – Neutral
Reaction Ratio – 5.3:1
Furnish – Recycled KLS (OCC)

Polymer Charge 10% – Linear Flocculant pH – Neutral
Furnish – Recycled KLS
Reaction Ratio 230:1

Polymer Charge 10% – Linear Flocculant pH – Neutral
Furnish – Recycled KLS
Reaction Ratio 5.3:1

APPLICATION OF MATERIAL TO A SUBSTRATE

The present application claims priority to UK Application No. 9416520.6 and UK Application No. 9419323.2.

TECHNICAL FIELD

The present invention concerns improvements in or relating to the application of material to a substrate and the insolubilization of material. More particularly, the present invention is concerned with a process for improving the characteristics of a substrate by the application of material thereto. In particular, the present invention will be described in relation to its preferred embodiment in which the present invention is directed to a process for adding material to paper during production thereof to increase the strength of the paper so produced.

BACKGROUND ART

In the preparation of various substrates, techniques have been developed to increase the strength of the substrate by insolubilizing materials onto the substrate to reinforce the substrate. One example of such a substrate is paper. In the production of paper, cellulose has been pulped in a slurry, and the slurry applied to a screen to orient the fibers and drain away liquids. Typically from the screen the paper is then squeezed between rollers to further reduce the water to produce a sheet of paper after suitable drying. The strength of the paper produced is dependent upon the nature of the pulp. For example, Virgin pulp of a given quality typically produces a much stronger paper than pulp from repulped paper of the same quality. Also, the strength achievable from the pulp decreases with each recycling evolution. Thus, there has always been an interest in additives which could increase the strength of the paper. Strength of the paper heretofore has been increased either by use of a size press operation or by wet end addition. The main concern is to eliminate size press additions because it is extremely inefficient from both a production and energy content standpoint. Typically, size press additions have been conducted by wetting the finished paper of flooded rollers with a starch solution to soak the starch into the paper subsequent drying thereby increasing the strength of the paper. This procedure suffers several drawbacks, among of them being, there is a limited amount of starch which can be added in this manner, thereby limiting the strength increase possible since the sheet can only absorb a fixed amount of solution. Furthermore, size presses are a large capital item requiring large amounts of space when coupled with the extra dryers required to redry the sheet.

Paper consumption has increased worldwide and is expected to increase further. A large portion of solid waste generated is paper and paper products. Many nations have undertaken efforts to reduce all types of waste products including paper in order to conserve landfill space. As a result, there is increasing interest and desire to recycle paper products. One disadvantage and limitation heretofore on the recycling of paper was the inability to achieve the desired strength of paper made in whole or in part from recycled pulp. The difficulties in achieving sufficient strength will become magnified as it is attempted to recycle paper which has already been recycled one or more times. Indeed in Europe where recycling is more intensive than in the United States it has become commonplace practice to make certain grades of paper entirely from recycled fiber especially in the boxboard grades.

The products are made from recycled boxes and mixed waste without the use of any virgin fiber and for certain grades e.g. fluting grade paper it is impossible to make the quality standard required without a large increase in the stiffness parameter as measured by the concorra medium test (CMT) or latterly the STFI test. To effect such improvements as is necessary, the mills have been forced to add starches by means of a size press in amounts varying between 3% and 10% based on fiber. To date it has been generally accepted that wet end addition of conventional reinforcing agents such as starches, carboxymethyl cellulose, polyvinyl alcohol etc., in various states of charge density or charge sign have failed to produce the quality improvements equivalent to a size press addition of say 4–10% starch for several reasons. These are:

1. The cost of the wet end additives has been excessive when compared to the total cost of size press addition of raw starch.
2. Technically, the technology of wet end addition has been incapable of adding sufficient reinforcing agent to the pulp such that it is retained in the correct fashion and provides the type of strength required.

Heretofore, the paper maker has tended to use wet end additions (i.e. chemicals that are applied in the pulp slurry) where possible to achieve the relevant increase in strength of a particular grade when using a recycled substitute furnish for the original virgin grade. There are many technical limitations on the use of wet end additives to achieve strength e.g. cationic starch, polyvinyl alcohol, xanthan gum etc. Generally, it is the presence of tramp materials usually referred to as "anionic trash" that inhibit the performance of these additives such that the strength improvements achieved (if any) are not economically viable. As an alternative the paper maker has resorted to size press technology to gain large increases in strength as the uptake is quantitative based upon saturation of the finished sheet with a known strength solution of reinforcing agent. The results obtained by this technology are recognised by the industry as superior to wet end addition especially in the area of the promotion of stiffness, a much valued property in many grades and especially so in boxboard.

However, it is recognised that size press additions are dry end additions and suffer large economic penalties. Thus there has been a continuing need to eliminate the size press operation to increase efficiency and decrease cost if the same quality improvements are available by wet end addition.

The prior methods for production of paper sought to improve the strength by the addition of polyhydroxylated polymers such as starch, polyvinyl alcohol, carboxymethyl cellulose, xanthan gum, guar gum and other such natural or synthetic binding agents which act by hydrogen bonding to the substrate. However in previous processes it has not been possible to fix from solution the charge neutral versions of these polymers into the wet formed sheet as they remain in solution and simply drain through the paper being produced. Several processes have been patented and demonstrated as methods for the attachment of these polymers to the substrate. The generally accepted methods are:

(a) Cationization of the polymer to allow increase substantivity to the anionic sites of the substrates eg; cationic starch.

(b) Insolubilization of certain anionic species with polyvalent metal ions such as aluminum, iron, zirconium eg; carboxymethyl cellulose.

These processes allow incorporation of the additive into the wet end of the paper making process thus avoiding the expensive extra process of size press addition which involves extra drying of the sheet from the rewet needed. However, these processes are subject to several limitations based on the quality of the fiber, anionic trash, pH etc., and had limited ability to increase the strength of the paper especially with respect to stiffness. The process of the present invention allows for a greatly improved performance especially in "dirty systems" operating at neutral pH's and allows for greatly improved strength by the addition of appropriate entities to the wet end of the paper making process over strengths availably by prior processes. The present invention in many applications, will allow the elimination of the size press resulting in considerable cost savings and process simplification. The advantages of the present invention include: (a) ability to increase strength substantially over prior methods, (b) the elimination of sizing equipment, (c) the reduction of refining, (d) the ability to select reactants, reaction conditions to achieve desired strength increases or other desirable properties in relation to characteristics of the pulp being utilized and (e) improved drainage equivalent to or greater than generally accepted micro particle technologies.

Since during the reaction of the components in the process is an almost quantitative production of gel like precipitate can be formed, (the physical properties of which varied with starting material).

The process of the present invention would have application in the following areas:

i) Reinforcement of paper to provide higher strength properties and possibly sizing by addition at the wet end of the paper machine.

ii) Provide a binder system with significant wet strength.

iii) Earth conditioning—production of the gel in any dust like substance produces a dust free wet solid that will retain moisture and probably act as a growth sustaining medium and consequently be usable in a situation such as land remediation where sand and/or any other light dusting soil needs to be stabilized for sufficiently long as to allow growth of ground cover vegetation. The product also stops dusting.

iv) Since a distinct gel can be made it is possible to extrude the product into fiber or other shapes which on drying will have quite good tensile properties. In the case of fibers it is probable that a matrix could be spun possessing super absorbent properties which could be used in domestic products such as diapers etc. It is also possible that production of a fiber after sufficient drying might produce a textile fiber possibly after exposure to a cross-linking agent such as formaldehyde or glyoxal.

v) With respect to (iv) above another application would be in the production of wound dressings because of the super absorbent quality.

vi) The use of high levels of the gel with respect to fiber produces very stiff board/wood like materials and it is envisaged that products such as medium density fiber board, hard board, or any other type of bound matrix board where conventionally phenolic resins or the like are used as binders could be replaced by this system. The advantages are economic, no volatile solvents, and the product can be wet formed without the production of a polluted effluent. This could offer significant advantages over present production techniques.

vii) We have found that as little as 1–3% of binder system in sand produces an extrudable/curable resin that binds the sand such that the sand can be used as a mold for such applications as foundry casting sand. The dried sand appears to break up in water after use producing non of the toxic pollutants associated with phenolic resins. Again there are no VOC's present at the formation stage and the whole reaction can be carried out wet and the molds simply oven dried.

viii) Dust suppression in utilities of all kinds such as red mud, coal dust processing or any other inherently dirty/dust process. The cake produced by reaction with the gel is water resistant and thus could be exposed to rain and wind.

ix) When one solution is layered on top of the other a very thin film of the gel is formed. This will probably have semi-permeable qualities and could be used in some specialists separation technologies using osmosis etc.

x) Ceiling/Wall boards can be made from mixtures of the gel with alumino silicate or pulp fibers using high percentages of the starch. These products would have high thermal resistance and could replace conventional lagging materials. Additionally, the system could be used as a binder to produce lagging products.

xi) Modified starches can also be used to produce different but anticipated effects by the inclusion of hydrophobes on the backbone. One such application is the removal and passication of stickies in paper making systems. We have discovered that if dispersed sticky materials such as ethyl vinyl acetate are dispersed in water to provide a cloudy dispersion, after contact with acetylated starches which have anionic functionality, if a flocculent is added to the same mixture a flocculation takes place which removes the turbidity associated with the sticky. Treatment of the raw emulsified sticky with the same flocculent at the same dose rate does not produce a clarification reaction. We believe that any hydrophobically substituted starch which has anionic sites can be similarly reacted to remove stickies as during the paper making process flocculents are added to the stock which would cause their retention.

xii) Any other type of board such as laminate equivalents for use in such articles as doors or any other decorative finish.

xiii) With one shot wet molding technology it is envisaged boxes could be made without the formation of paper.

In addition to the specific applications referred to above, it is also considered possible to utilize a cationic high charge starch material having a long chain backbone, and to mix same with an anionic starch to cause the required precipitation. It is believed that such application would be particularly advantageous in connection with certain third world countries who are able to mix the two identified starches together and produce a product, which could be used for forming board material and the like.

It would thus be seen that the process of the present invention has numerous applications and the mixing of the two integers produces a product which has high strength and can be used in a number of applications.

The strength characteristics of paper are evaluated in many different ways. There is strength to be measured in the machine direction, cross machine direction or thickness direction. Various types of strength measurements are burst, tear, tensile, stiffness, taber stiffness, ring crush, fold endurance, concorra medium test (CMT) and STIFI. These physical properties (amongst others) can be measured using standards of the Technical Association of Paper Processing Industry (TAPPI). The present invention has the additional advantage that by varying the amount of reactants it is possible to effect changes in the different types of strength, thus, the present invention has the advantage of the flexibility to selectively affect various types of strength.

SUMMARY OF THE INVENTION

In one aspect, the present invention relates to a method to improve the strength of the substrate such as paper pulp by the use of flocculents and starches to improve the strength of a vinyl substrate. In a preferred embodiment, the invention is the addition of a cationic polymer capable of insolubilizing a starch which is added to the slurry containing the pulp in an amount equal to or less than the amount needed to neutralize the anionic charge of the slurry components. The method also involves adding to the slurry a predetermined amount of starch such that the amount of starch added to the amount of cationic polymer added is equal to 75% to 125% the reaction ratio between the starch and cationic polymer or in an amount exceeding the reaction ratio. Subsequently the reactive mixture will need an appropriate degree of shear to break up the flocculation that is observed. In extreme cases the flocculation can be very substantial and need the input of a shear value equivalent to light refining or alternatively in the weakest cases a gentle shear as may be observed in the cleaners of the pre-headbox system.

In a preferred embodiment of the invention, the cationic polymer is added to the slurry containing the substrate and thoroughly admixed therewith prior to the addition of the starch component. The cationic polymer useful in the invention is a polyhydroxide polymer or an acrylamide polymer having a molecular weight above 150,000. Preferably the cationic polymers have a molecular weight of one million or more. Other polymers which are useful are polymers known to be flocculating agents which have a molecular weight above 150,000 and preferably of one million or more.

In a preferred embodiment the present invention relates to the addition of sufficient cationic polymer to neutralize 10% or more of the charge of the slurry and less than or equal to the amount necessary to completely neutralize the charge of the slurry. Also added to the slurry bath is a predetermined amount of starch followed by suitable shear.

DETAILED DESCRIPTION

Figure 1:
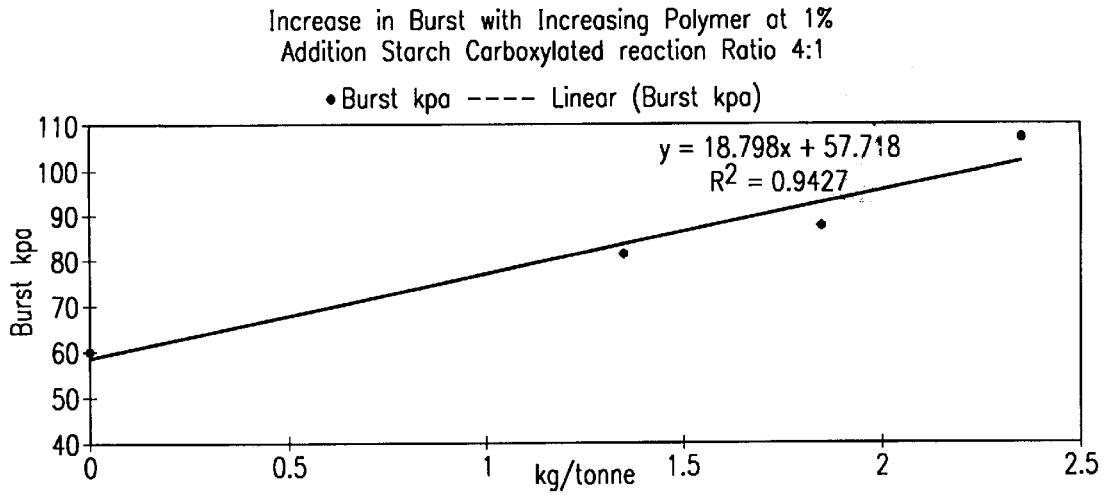
FIG. 1 is a graphical illustration of the increase in burst values with increasing polymer at 1% addition of starch carboxylated with a reaction ratio of 4:1.
Figure 2:
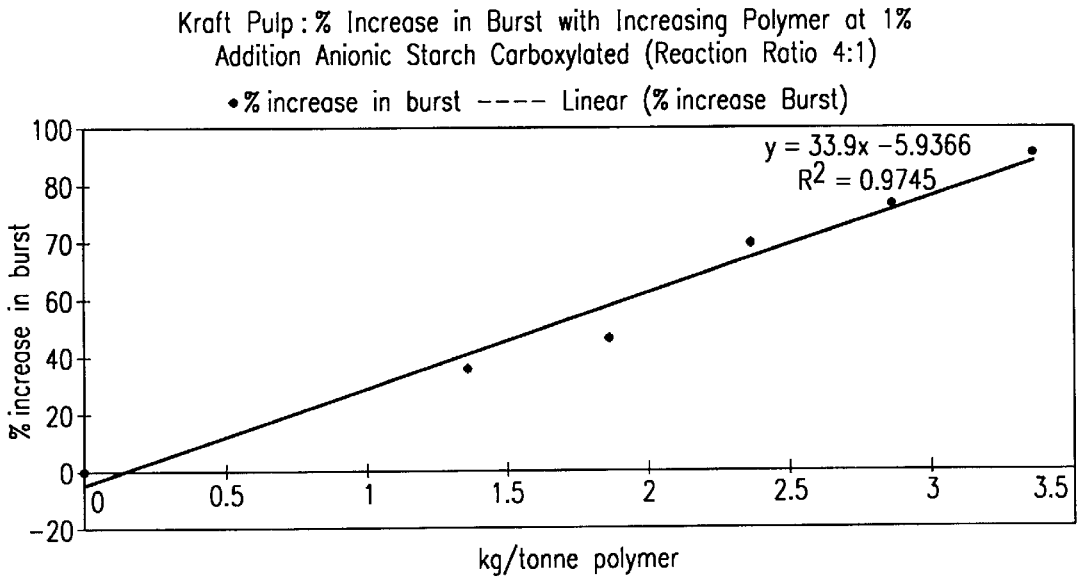
FIG. 2 is a graphical illustration of the percentage increase in burst with increasing polymer at 1% addition of anionic starch carboxylated to kraft pulp with a reaction ratio of 4:1.
Figure 3:
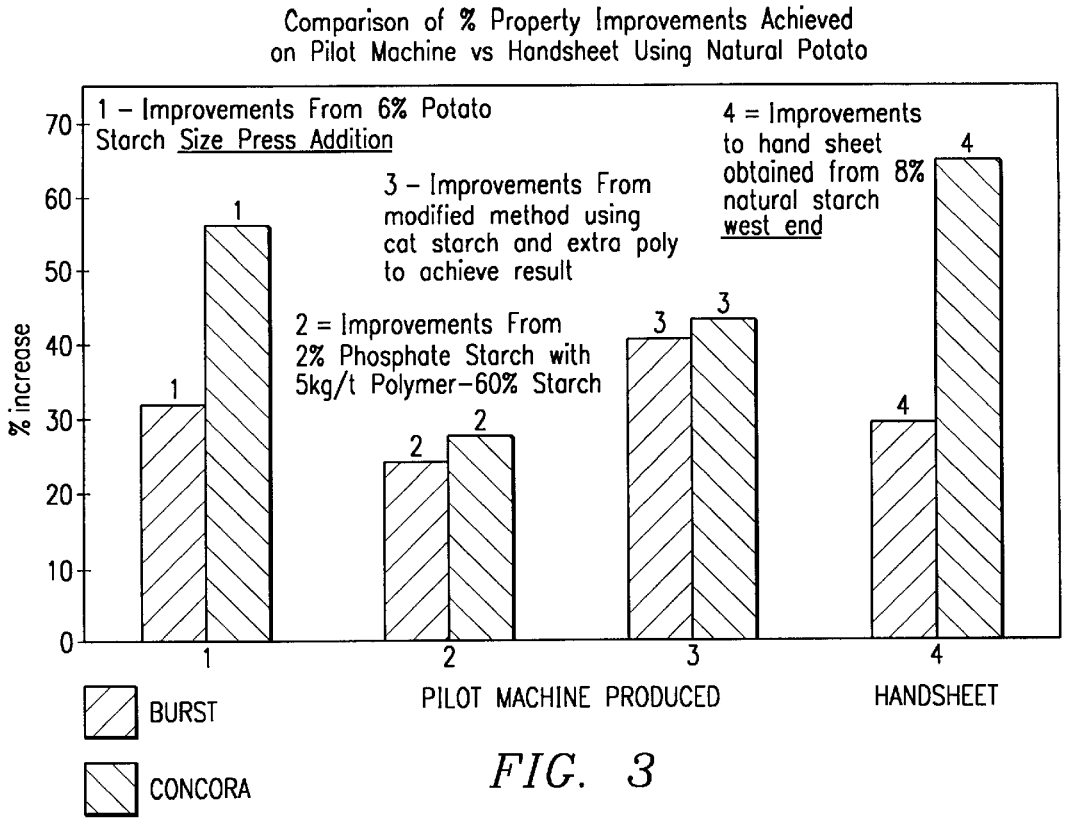
FIG. 3 is a graphical comparison of the percentage improvements in burst and concora achieved on a pilot machine versus a hand sheet using natural potato.
Figure 4:
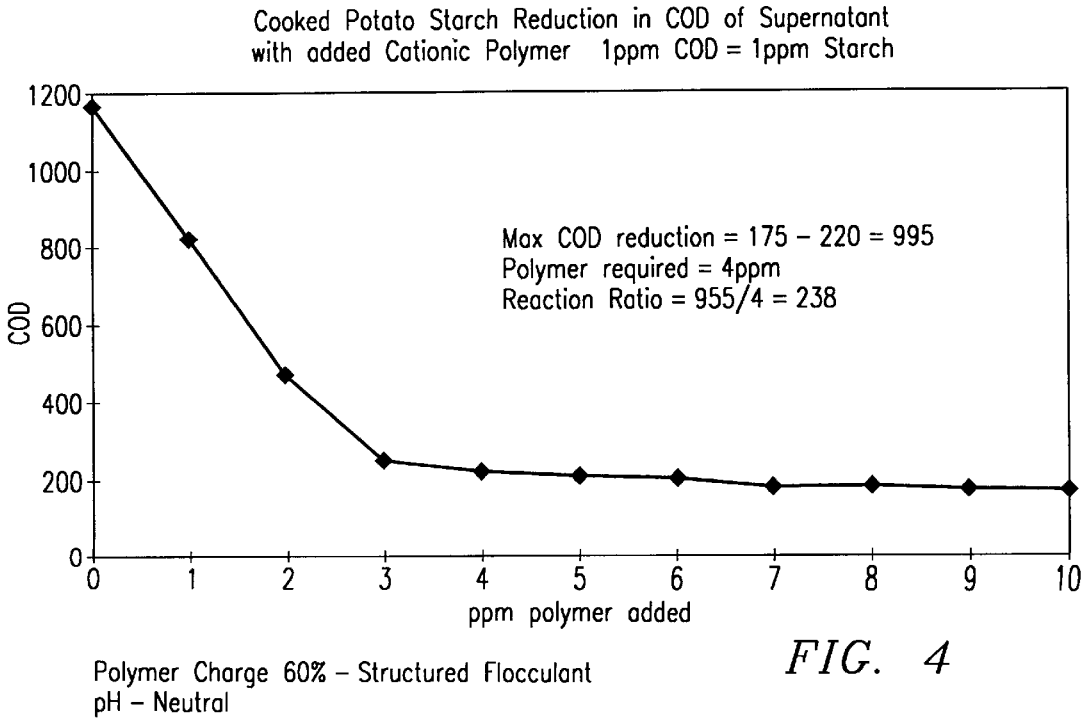
FIG. 4 is a graphical illustration of the cooked potato starch reduction in COD of supernatant with added cationic polymer.
Figure 4A:
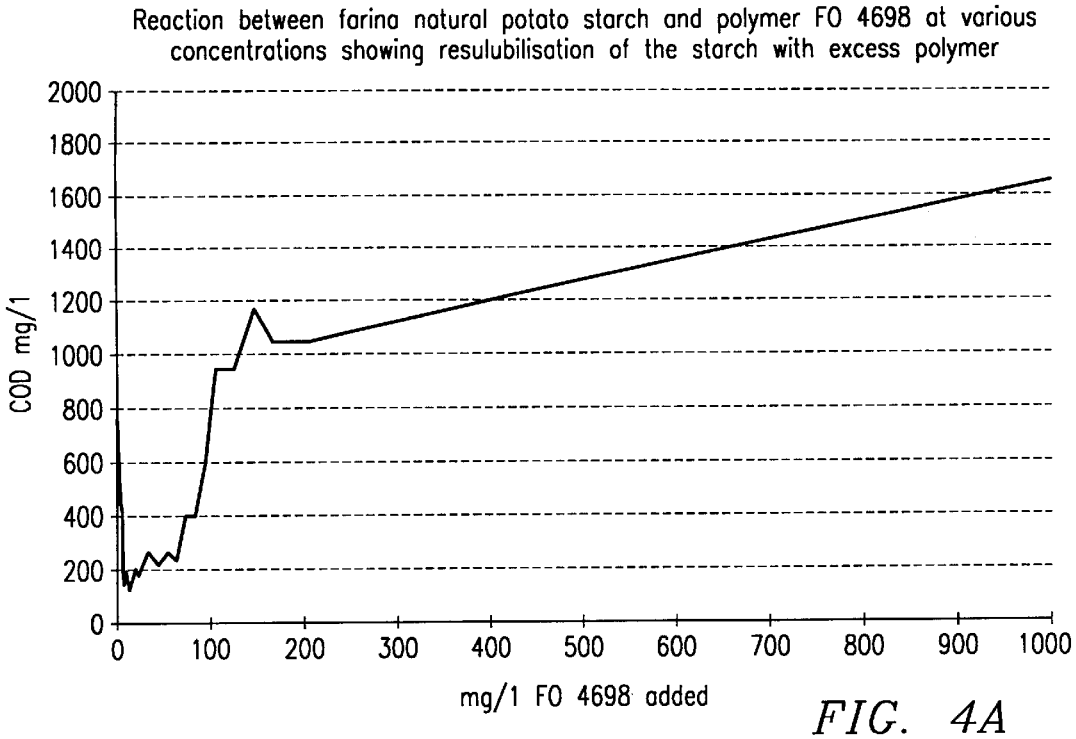
FIG. 4A is a graphical illustration of the reaction between farina natural potato starch and polymer FO 4698 at various concentrations showing resolubilization of the starch with excess polymer.
Figure 5:
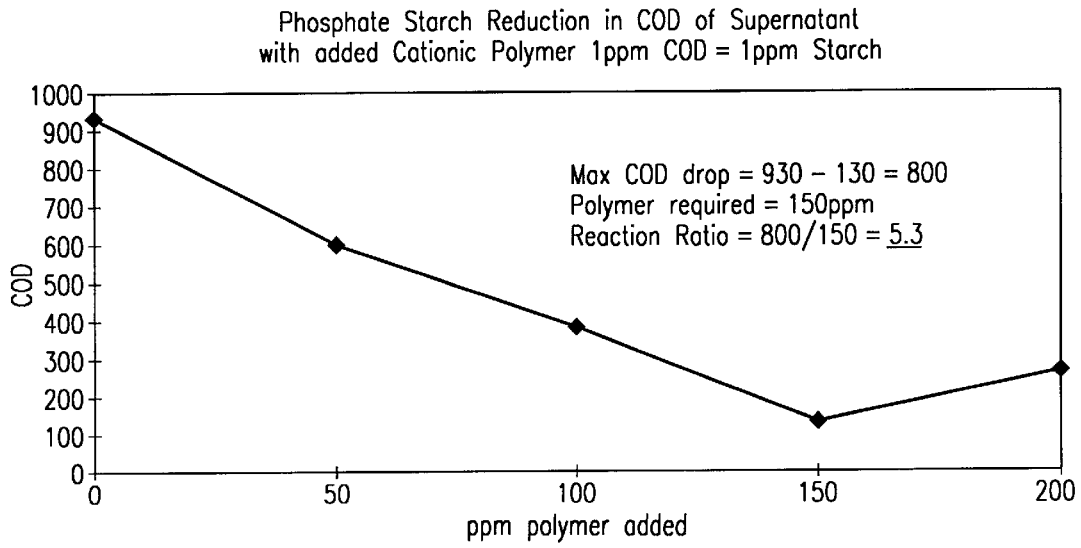
FIG. 5 is a graphical illustration of the phosphate starch reduction in COD of supernatant with added cationic polymer.
Figure 6:
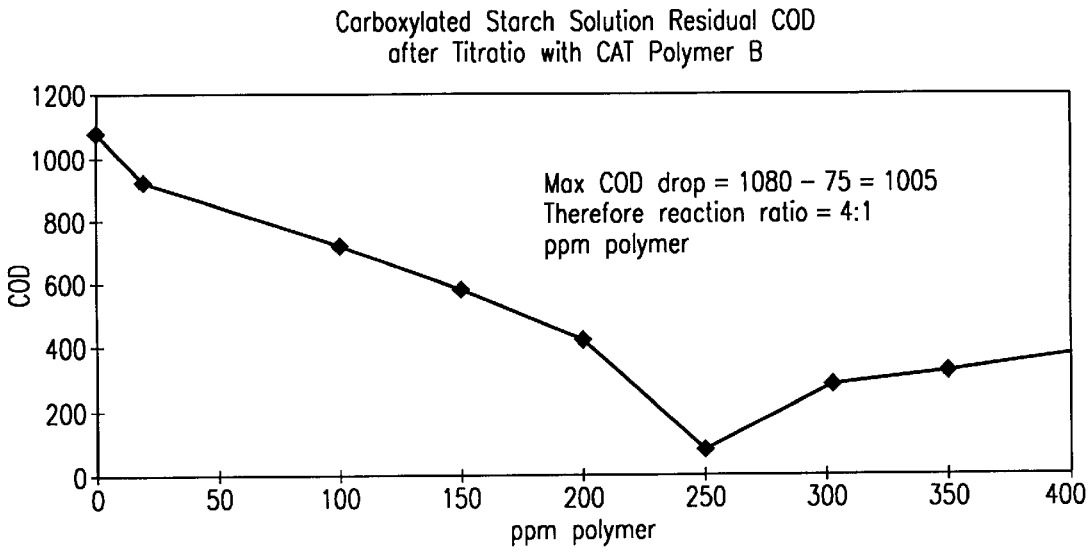
FIG. 6 is a graphical illustration of the carboxylated starch solution residual COD after titration with CAT polymer.
Figure 7:
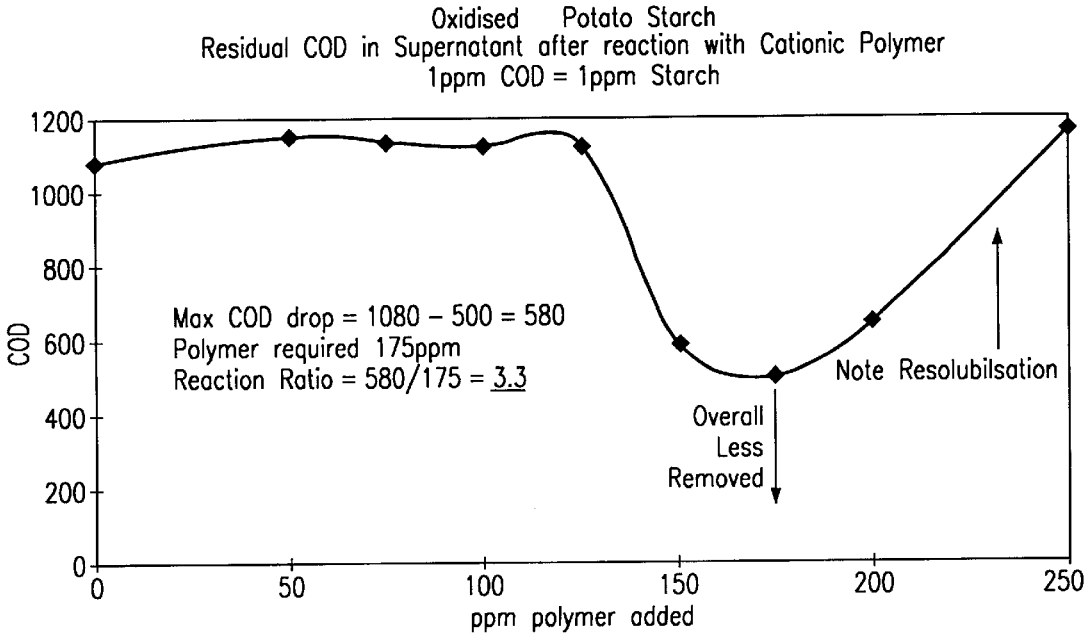
FIG. 7 is a graphical illustration of oxidized potato starch residual COD in supernatant after reaction with cationic polymer.
Figure 8:
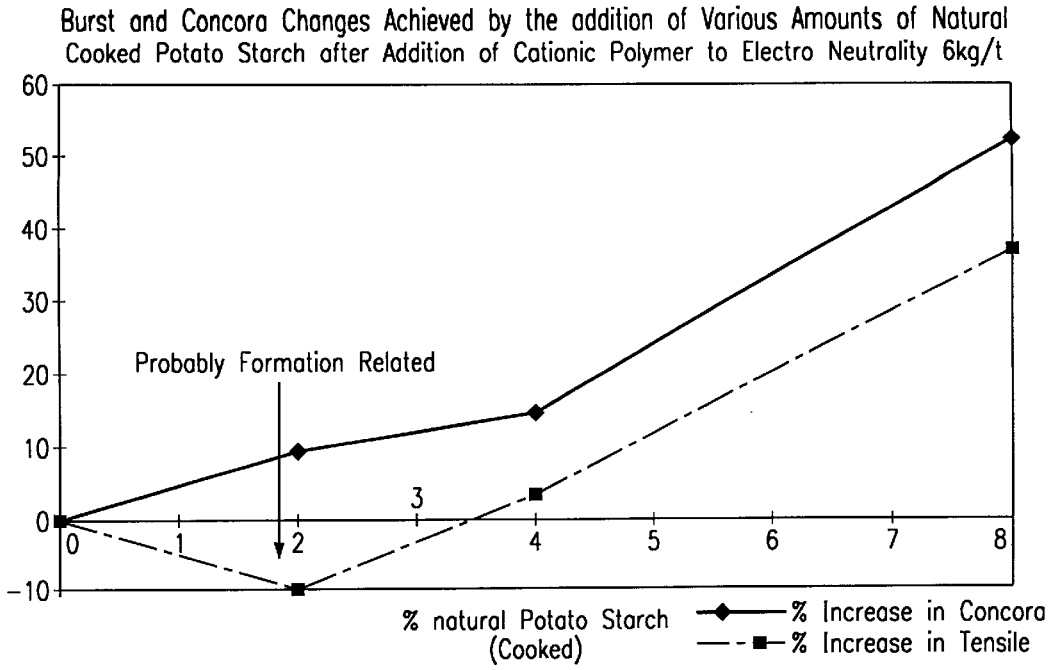
FIG. 8 is a graphical illustration of burst and concora changes achieved by the addition of various amounts of natural cooked potato starch after addition of cationic polymer to electro neutrality 6 kg/t.
Figure 9:
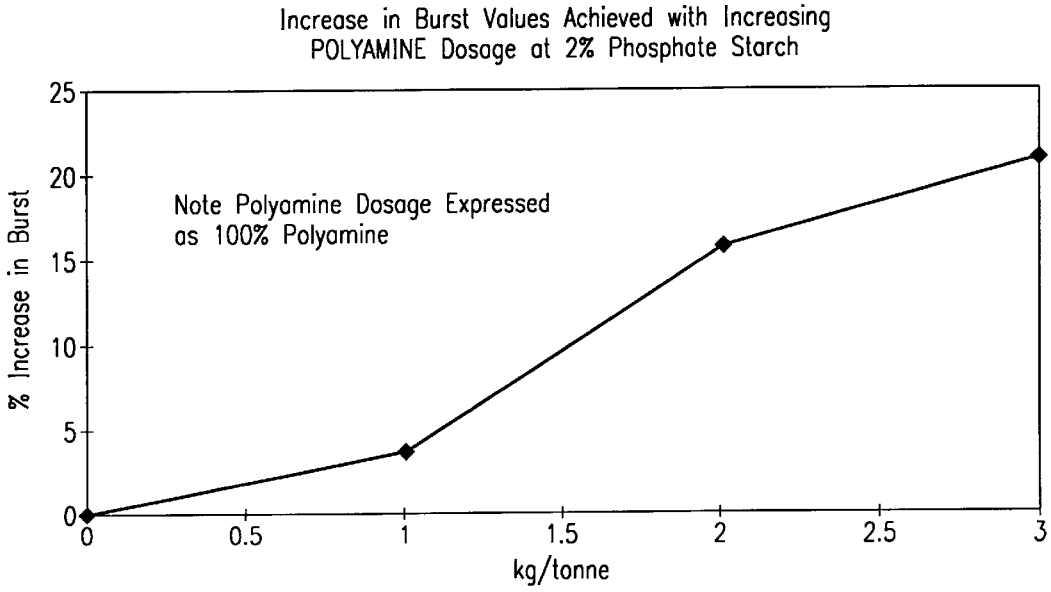
FIG. 9 is a graphical illustration of the increase in burst values achieved with increasing polyamine dosage at 2% phosphate starch.
Figure 10:
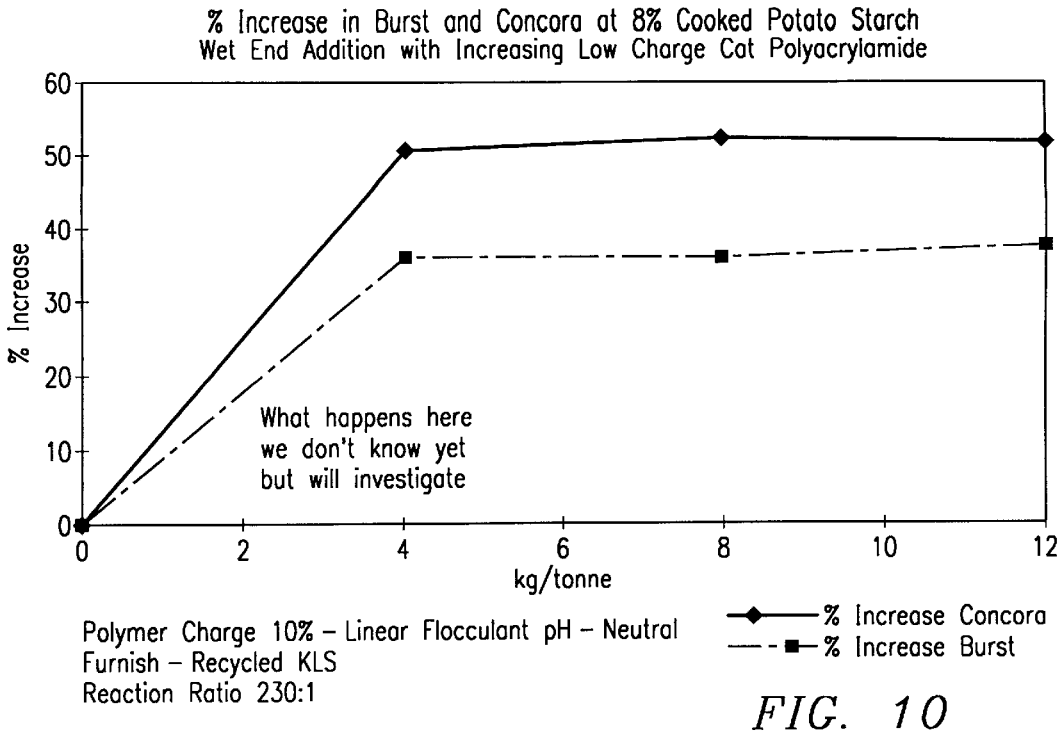
FIG. 10 is a graphical illustration of the percentage increase in burst and concora at 8% cooked potato starch wet end addition with increasing low charge cationic polyacrylamide.
Figure 11:
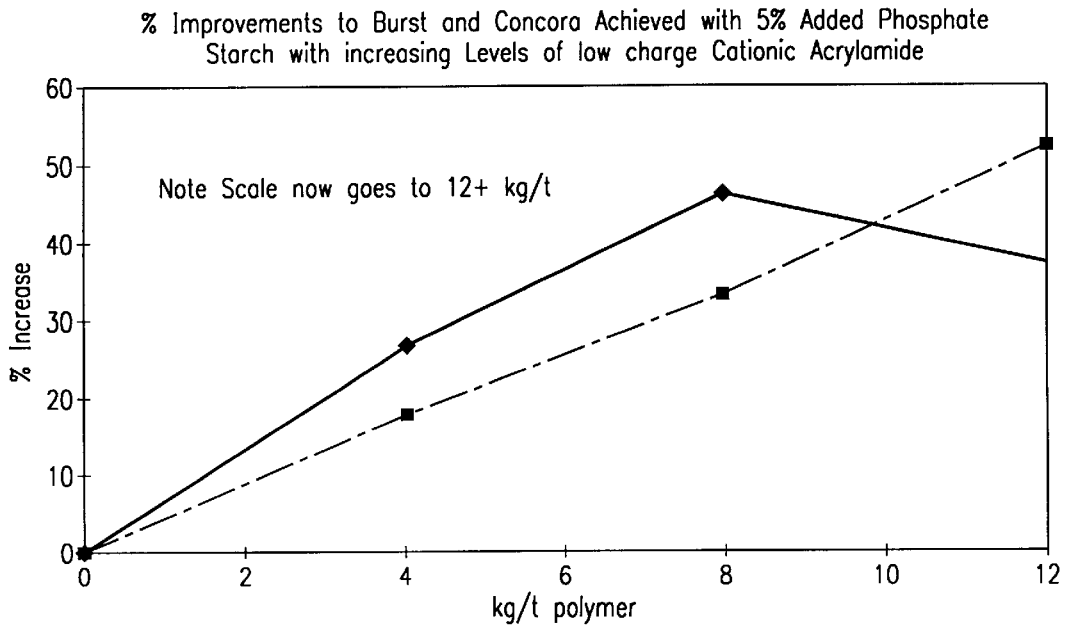
FIG. 11 is a graphical illustration of the percentage improvements in burst and concora achieved with 5% added phosphate starch with increasing levels of low charge cationic acrylamide.

It is accordingly one aspect of the present invention to provide a means whereby a functionalized polyhydroxy or polyacrylamide polymer of natural or synthetic origin can be included in the paper, the addition taking place at the wet end of the paper making machine. The present invention will be described in detail with regard to paper making, but those skilled in the art will recognize that it has applications to other substrates as well.

The present method may be used with a substrate which has a charged character. The substrate may be charged either positively or negatively. In typical paper processes, the substrate is the paper pulp and slurried pulp at the wet end of the process carries an anionic charge. The process of the present invention will be described with reference to the substrate carrying an anionic charge, but the principals of the invention apply when the charges of the various components are reversed.

In the preferred embodiment, the present invention is a process for insolubilizing a starch onto a substrate having an cationic polymer associated therewith. Depending upon the selection of substrate, cationic polymer and starch, the properties of the final paper product can be varied as desired.

It is determined how much cationic polymer is necessary per unit weight of the substrate to neutralize the anionic charge on the substrate. This may be done experimentally by placing a known amount of substrate in a container, forming a slurry. Thereafter, a charge monitor (particle charge analyzer) is used to monitor the charge and the polymer is added incrementally until the charge of the substrate is neutralized.

In some commercial operations, the slurry will be dirty in that it will also contain charged particles of non-substrate material which the cationic polymer will neutralize. Thus, for the same unit weight of substrate the amount of cationic polymer needed to neutralize the charge of the substrate can vary because of other material present in the slurry. The amount of cationic polymer added is preferably an amount sufficient to neutralize 10% or more of the charge in the substrate slurry and equal to or less than the amount needed to completely neutralize the charge.

In addition to the cationic polymer, a starch is added to the substrate slurry and preferably sufficient shear is applied to break up the flocculation that will take place. The starch is added in amounts sufficient to insolubilize into the substrate and associated polymer. Preferably the starch is added in an amount less than 125% of the reaction ratio amount. The reaction ratio amount of starch is that amount of starch per unit weight of polymer at which the amount of starch to polymer is equal to the reaction ratio. For example, if the starch:polymer reaction ratio is 4:1 then 4 grams of starch per 1 gram of polymer is the reaction ratio amount. Thus, in this example, 125% of the reaction amount would be 5 grams of starch.

The reaction ratio can be determined by placing the starch in a aqueous solution and then adding polymer incrementally to precipitate the starch. After the addition of each increment of polymer and after settling for several minutes the COD level is measured (chemical oxygen demand) A one ppm reduction in COD is equal to a one ppm insolubilization of starch. At the point where further addition of polymer does not further reduce the COD one has achieved the maximum COD reduction. The reaction ratio is determined by taking the back COD reduction and dividing it by the ppm of polymer added. It had been discovered that if one continues to add polymer that eventually one will begin to resolubilize the starch, as shown in Graphs 4, 4A, 5, 6 and 7.

Graph 4 represents the reduction in COD when cooked potato starch was precipitated using a cationic polymer sold under the trade designation FLOEGER 4698. Addition of four parts per million polymer resulted in a maximum COD reduction of approximately 955. Each part per million COD reduction is equal to the precipitation of one ppm starch. Thus, the reaction ratio was 955/4 or 238.

The full curve of this reaction is shown in Graph 4A showing how readily the starch is resolubilized completely by excess polymer.

Graph 5 shows experimental determination of precipitation reaction for a phosphate starch Retabond AP, a cold water soluble phosphate starch supplied by Avebe starches. With the same cationic polymer as in Graph 4, for this particular starch in reaction to the polymer, the maximum COD drop in parts per million was 800, was accomplished by adding 150 ppm polymer giving a reaction ratio of 5.3.

Graph 6 shows determination of the reaction ratio of a carboxylated starch Quicksolan CMS by Avebe Starches with a cationic polymer FLOEGER F04550BPM. For these two components, maximum COD drop was 1,005 achieved by using 250 ppm in the polymer giving a reaction ratio of 4:1.

Graph 7 shows determination of the reaction ratio for an oxidized cook-up potato starch Avebe Perfectamil A2177 with the cationic polymer F04550BPM. The Graph shows that maximum COD reduction of ppm was 580 achieved by additional 175 ppm polymer given a reaction ratio of 3.3.

Note also that the degree of insolubilization is adversely effected by the breakdown of the stock structure (oxidation) or of the ready resolubilization of the precipitated complex by excess polymer.

Graphs 5 to 7 demonstrate that additions of starch greatly in excess of the reaction ratio amount will not result in appreciable additional insolubilization. The less starch in the reaction ratio amount can be used. This specific amount of starch added depends upon the type of strength to be improved.

The specific amounts of cationic polymer, and starch will depend upon the amount of the starch desired to be added, the fixation ratios of the starch and polymer. By judicious selection of the polymer and the starch, one can provide a great variety of possible combinations through the selection of a particular combination will depend on such items as cost, desired end properties, and processing limitations.

An experiment was conducted where differing amounts of natural potato starch were cooked and various amounts added to a pulp slurry (2%) of OCC and mixed waste from a flurring board manufacturer containing the cationic polymer having 60% charge density described previously with different levels of potato starch. The effects on bursting strength and concorra are reflected in Graph 8. The amount of polymer present was that amount sufficient to neutralize the charge in the substrate slurry. It is believed that decrease in burst strength shown at 2% in the graph is probably an experimental error and that normally there would be a slight increase in tensile strength.

The above experiment was repeated only utilizing 8 percent of a cooked natural potato starch which had a reaction ratio of 200:1 to the polymer, the polymer having a lower charge density (10%) to allow greater weight of polymer onto the fiber.

| Sample | Amount of Polymer* Added in Kilograms/Ton of Substrate | Percent of Starch** Added by Weight of Substrate | Percent Burst Strength Increase Over Untreated Pulp | Percent Increase in Concorra Over Untreated Pulp |
|---|---|---|---|---|
| 4 | 4 | 8 | 25.9 | 50.8 |
| 5 | 8 | 8 | 25.9 | 52.6 |
| 6 | 12 | 8 | 38.2 | 51.9 |

A series of experiments were conducted to compare strength improvements possible by the method of the present invention. First, a base sheet of 100 gms made from pulped coreboard as original furnished (OCC and mixed waste) was produced on the pilot machine owned by the University of Manchester. The burst and concorra strength of the paper without additives was measured. This strength was used as the baseline and is represented as sample 0 in Graph 3. Next continued production of the sheet on the pilot machine was then subject to a size press addition of 6% by weight of fiber of natural potato starch using a solution of 10% starch. The percentage of increase and concorra and burst are set forth in Graph 3 as sample 1. A sample of paper was made utilizing the pilot machine but by adding five kg/tonne by wet end addition of the 60% charge density polymer and 2% by weight of phosphate starch Retabond AP (based on weight of the pulp). The resulting paper was not subjected to sizing operation. Nevertheless, the paper produced demonstrated improved burst and concorra strength over the base value 0. The making of this paper is difficult as there are several significant changes to pulp quality that detrimentally affect the runability of the machine. Taken in order, the effects are:

a) The quality of the produced precipitate is gel-like and sticky and causes the wet sheet to stick to the first press granite roll very tenaciously such that it is impossible to produce paper for any reasonable length of time. This effect tends to be greater when 1% addition of this particular phosphate starch with the level of flocculent used. As this machine was a pilot machine, it was possible to lift the granite roll and use the rubber coated second press to achieve the required dewatering. The final sheet was able also to run through the dryers and its properties measured.

b) The formation induced by the high level of flocculent with high charge density is grossly overflocculated and it is necessary to break up the formation with shear prior to admission to the flow box ahead of the machine wire.

This was accomplished by making the addition in the thick stock and passing the highly flocculent material through a mini-refiner to break up the flocculation. Even so, the stock was somewhat overflocculated.

c) Drainage is positively effected in that it was found that the stock drained extremely fast, approximately 50% faster than untreated material and apparently faster than a conventional microparticular treatment.

d) Tension was positively effected and residual COD values were extremely low.

Another paper was made on the pilot machine in which an attempt to stop or ameliorate the first press observed in the previous run. Laboratory experience suggests that particular grades of swollen particulate cationic starch can be captured by the anionic starch/cationic polymer complex and gave large increases in the strength of the paper (especially fluting grade recycled paper). Additionally, it was found that this method would also reduce adhesion to the granite roll to increase runability.

After much experimentation it was concluded that synergistic results were obtained if the order edition was:

a) Polymer added to the thick stock at approximately 1–2 kg ton and allowed to mix;

b) Swollen cationic starch added to the thick stock at an approximate amount of 2.5% and allowed to mix;

c) Phosphate starch added in an appropriate amount resulting in a gross and powerful flocculation.

d) The whole mixture fed to a light low refiner to break up the floc;

e) Final addition of paper, e.g. 1–2 kg/ton ahead of the cleaners prior to emission onto the wire.

This produces a paper of good formation and much improved mechanical properties with about equivalent values of concorra as a size press treated sheet and a small improved burst result.

Further work was conducted into the nature of the insolubilization which revealed that it is possible to achieve the same sort of improvement more simply by reacting high ratio starches with polymer. Additionally, it was realized that tensile properties and rigidity properties did not necessarily increase proportionately when they are improved as can be seen by the percentage improvement of burst from side press addition versus the percentage improvement of burst at wet end relative to the concorra value.

Accordingly, it was found that if natural potato starch (a high ratio reaction starch) was added at high levels, for example 8%, a similar amount up to size press potato starch might be achieved.

Since the original experiment had been completed on the pilot machine, it was decided to use the same furnish and make handsheets of the same basic weight as the pilot machine and compare a blank with 8% natural potato starch added. The results are shown in sample 4 which show a very similar pattern in improvement of concorra and burst to the size press. Repeated experiments using natural potato starch have shown consistent improvement in tensile strength of approximately 30–35% and concorra of 50–70% by use of this method. These two samples demonstrate that the method of the present invention yields significant improvements in strength without the need for sizing operations.

Finally, trials were conducted on a commercial machine producing fluting grade paper at 1.5 ton per hour using entirely recycled old cardboard containers and mixed waste as furnish.

The machine operated at a speed of 115 meters per minute and additions made were 2% carboxymethylated starch and 0.5% of 60% charged density acrylamide previously described.

The products were added close together in thick stock and sent to a refiner.

The results obtained are as follows:

| | Blank | Average Treated Sample | % Increase in Parameter |
|---|---|---|---|
| Basis Weight | 110 gsm | 109 gsm | — |
| Concorra (N) | 144 | 214.33 | 48.84 |
| Ring Crush | 123 | 159 | 29.27 |
| Burst | 180 | 215 | 43.33 |

This was in a typically dirty system which showed significant clean up of suspended solids in backwater systems after treatment. Retention increased from 60% to 77%.

The previous section has showed what is achievable by one skilled in the art using the reaction technology as applied to starches. However, other work was conducted using anionic polyvynl alcohol, or caboxylmethylcellulose, and apart from structural confirmation and components, the main different between these two polymers is molecular weight and charge density, and similar results were obtained.

Tests of prior art methods using recycled fiber in dirty backwater systems demonstrated that they were severely limited in providing increased strength to the final paper product.

Various experiments were carried out utilizing the polymers polyvinyl alcohol and anionic starch in conjunction with conventional coagulant products. The following were used:

1. Polyamines (low to high molecular weights)
2. Polydadmacs (low to high molecular weights)
3. Aluminum Salts
4. Ferric Salts
5. Zirconium Salts
6. Wet strength resins (MF).

In all tests which were carried out, no increase in strength could be achieved in the paper even at very high dose rates of polymer. However, it was possible to show that saturation of a dry filter paper with anionic polymer did produce very large increases in strength. It therefore appeared for one reason or another that the reaction product of the anionic polymer with the coagulant, was either not insoluble or unsuitable for strength improvement. Accordingly, it was not possible to fix the polymer to the fibrous material used in the paper production in the paper making machine. The method of the present invention overcomes this deficiency.

In the preferred embodiment of the present invention, the cationic polymer is preferably added to the substrate prior to the addition of anionic starch. The cationic polymer associates with the substrate and provides locations where the starch can affix itself to the substrate and cationic polymer. It has been determined that the insolubilization of the anionic starch is approximately linear as shown by the increase in strength in Graph 2. This relationship holds true as long as the cationic polymer concentration is equal to or below that concentration needed to neutralize the anionic charge on the pulp.

The amount of cationic polymer needed to neutralize the anionic charge on the pulp can be determined theoretically or more conveniently, experimentally. Experimentally, a known weight of pulp is placed in an aqueous solution and the selected cationic polymer is added while monitoring the charge of the solution. The charge of the solution may be easily monitored with an instrument such as a conventional particle charge analyzer. Once this value has been determined, then the starch to be utilized can be determined by picking a starch with an appropriate fixation ratio to the selected polymer because the weight of starch which can be deposited can be approximated by the weight of the cationic polymer utilized times the fixation ratio of the starch to polymer.

An experiment was conducted in which virgin kraft pulp was placed in a beaker. A cationic polyacrylimide polymer, sold by SNF Floerge under the trade designation of F04698, having a 60% cationicity was utilized. It was determined that this polymer caused neutralization of the charge density of the pulp at the level of 2.5 to 3.5 kilograms per ton (1000 kg). To demonstrate the insolubilization of starch, a series of experiments were conducted in which one percent of a carboxylated starch, specifically Quicksolan CMF was added to mixtures of virgin kraft pulp with different concentrations of the cationic polymer. Paper was then produced by the various samples and tested for burst strength. Graphs 1 and 2 demonstrates the increased strength achieved by increasing the cationic polymer content by holding the additional starch constant.

It was found that when the cationic polymer was added in the concentration greater than that needed to neutralize the charge of the pulp, that the strength fell off even though the amount of starch was increased. Although not bound to any theory, it is believed that when the cationic polymer content is equal to or below a level needed to neutralize the charge on the substrate, that the polymer will associate with the substrate and assist in the insolubilization of starch upon the substrate. However, where the amount of polymer exceeds the amount needed to neutralize the charge on the substrate, the polymer not associated with the pulp competes with that associated with the pulp.

The amount of polymer used for a particular substrate to be insolubilized could be increased by selecting a cationic polymer having a lower charge density. The charge density is taken from manufacturers specifications.

In this manner the amount of starch added can be increased if the reaction ratio between the starch and cationic polymer with a lower charge density has the same reaction ratio as a polymer with a higher charge density.

It is believed that with the lower charge density polymer, more polymers available for association with the substrate. This in turn allows for a greater insolubilization of the starch. With the same pulp, the ten percent charge density polymer could be used in amounts up to six times greater than a polymer with a sixty percent charge density cationic polymer. Experiments were conducted wherein the Kraft pulp was prepared and the cationic polymer, FLOEGER CW711, was added which had ten percent charge density to the samples. Thereafter, a starch, Retabond AP was added and the samples gave the following increase in burst strength over paper made with the untreated pulp.

| Sample | Amount of Polymer* Added in Kilograms/Ton of Substrate | Percent of Starch** Added by Weight of Substrate | Percent Burst Strength Increase Over Untreated Pulp | Percent Increase in Concorra Over Untreated Pulp |
|---|---|---|---|---|
| 1 | 4 | 2 | 18.5 | 27.5 |
| 2 | 8 | 2 | 33.2 | 46.3 |
| 3 | 12 | 2 | 53.7 | 37.6 |

*Polymer was FLOEGER CW711.
**Starch was phosphated starch Retabond AP.

Cationic polymers are useful in the invention and include branch-chain cationic polyacrylamide polymers, linear acrylamide homo and copolymers. The molecular weight should be 150,000 or greater, and preferably 1,000,000 or greater.

Starches which have been found useful in the invention include any anionic functional starch of sufficient molecular weight to be insolubilized. Furthermore, polyvynl alcohol and caboxylmethylcellulose or any other anionic conventionally accepted retention aid can be used.

In another aspect, the present invention relates to the use of an anionic polymer which has been functionalized by cationic flocculent materials. Certain polymers may be used in place of starch, for example a polyvinyl alcohol which has been functionalized to be anionic. However, these are less desirable because they are much more expensive than starches and their reaction ratios are usually higher necessitating extra polymer.

Surprisingly it has been discovered, as a result of further experimentation, when solutions of anionic polymer which have been functionalized, by making same anionic, are exposed to cationic flocculent materials, there is an immediate reaction which causes insolubilization of the polymer almost quantitatively and in a form suitable to provide strength improvement after suitable shear of the immediate flocculation. In another embodiment the present invention is a process wherein a anionic polyhydroxy high molecular material is admixed with an apparently flocculent, the admixture of the polyhydroxy high molecular material and the flocculent is mixed with a substrate, such as paper pulp, to cause insolubilization of the polyhydroxy material into the substrate.

Further experiments have shown that not only are polyhydroxy grades reactive in this fashion but that materials which contain a substantial degree of hydrophobic elements also react in a similar manner. Accordingly it has been discovered by experimentation that it is possible to precipitate any form of fully hydroxylated or partially esterified, etherified or any other functionalized moiety, by the use of a cationic flocculent, such flocculent being used as a means of fixing polymer.

Accordingly a process has been discovered whereby polyhydroxy polymers can be incorporated into a paper being produced in a paper making machine, at the wet end of the process, such addition of polymeric alcohol providing internal strength and/or wet strength or sizing or any of the other properties reported by size press addition of polymeric alcohol, eg: fold, tear, gloss, etc, into a sheet of paper. The process discovered is applicable to any polyhydroxy high molecular weight polymer or like material if same is rendered ionic.

According to another embodiment of the present invention there is provided a process of applying a polyhydroxy high molecular weight polymer or like material to a substrate, comprising adding to a solution of such material in ionic form a flocculent of oppositely charged form in order to insolubilize such material and thereafter applying such insolubilized material to said substrate.

It has been discovered that if any polyhydroxy high molecular weight polymer, eg: polyvinyl alcohol, starch, carboxymethyl cellulose, xanthan gum, dextran gums or any similarly structured material which possesses the capability of producing a large degree of hydrogen bonding to cellulose or other substrates of a similar nature, is reacted utilizing suitable technology eg; by reaction, a pendant strongly ionizable group, such as sulphonate, carboxylate, phosphate, may be incorporated in said polymer. Preferably the molecular weight should be 120,000 or above. Such resultant polymer is then resolved and reacted with a suitable material of opposite charge whereby the polymer may be insolubilized thereafter applying to a substrate and retained thereon or therein.

When utilizing the polymer referred to above with a pendant carboxylate moiety attached thereto a cationic flocculent is utilized in the form of polymer carrying sufficient permanent cationic charge. In this connection it is possible to use a polyacrylamide cationic polymer as commonly used in water treatment in the paper industry, but each is not limited in structure to pure polyacrylamide so that potentially other useful moieties such as copolymerized acrylamide/diallyldimethyl ammonium chloride or mannich acrylamides or other such relatively high molecular weight cationic polymer or copolymer which carried permanently quaternized nitrogen, may be used, including cationic starch, polyvinyl alcohol or other such moiety.

In tests carried out with anionic polyvinyl alcohol, it is anticipated that the lower molecular weight limit of the added polymer at which insolubilization does not proceed may be between 150,000 and 250,000. In studies carried out regarding interaction between a low molecular weight anionic polyvinyl alcohol and cationic acrylamides it has been found that the degree of insolubilization is related not only to the concentration of the cationic species in solution but also the concentration of polyvinyl alcohol and that the charge density of the acrylamide.

Tests have been carried out with both high and low molecular weight material which contains approximately 30% hydrophobic residues. It was indeed highly unexpected that the low molecular weight grade of anionic polyvinyl alcohol used in such experiments would give the substantial strength improvements that have been discovered. Further experiments have been carried out utilizing higher molecular weight material and fully hydrolysed grades of anionic polyvinyl alcohol. It has been discovered that the use of high molecular weight material provides stronger bonding and that the fully hydrolysed grades act in a similar manner to the partially hydrolysed grades.

Moreover, it has been discovered that substantially more polyvinyl alcohol can be incorporated in paper utilizing the process of the present invention than was possible heretofore. Having regard to the previous utilization of addition of polyvinyl alcohol to dried paper, it is believed that a maximum of 2% polyvinyl alcohol could be incorporated therein, the process also providing the advantage of adding the polyvinyl alcohol at the wet end of a paper making machine. Accordingly, the process of the present invention permits incorporation of polyvinyl alcohol of all ranges of molecular weights in to the wet end of a paper making machine. Additionally, because of the insolubilization process that takes place, it is believed that micro particle technology is involved and such may be used to improved draining. This is believed to be an important aspect of the technology under-review since it was observed that paper stock that was previously treated solely with cationic flocculent underwent a dramatic flocculation upon addition of the ionic polyvinyl alcohol.

Thus, the material itself appears to act as an anionic flocculent; moreover when insolubilized by cationic material as described above, then it is believed that enhanced drainage will take place.

It has been discovered that when incorporating 5% of polyvinyl alcohol into paper produced in a paper making machine, such polyvinyl alcohol being treated in accordance with the process of the present invention, and introduced into the wet end of the paper making machine, that the paper so produced has a bursting strength which is approximately 90% greater than paper produced heretofore having polyvinyl alcohol added thereto once the paper had been produced and dried. Thus, not only does the process provide the advantage of adding the polyvinyl alcohol to the paper at the wet end of the paper making machine, thereby avoiding additional steps once the paper has been produced, but additional amounts of polyvinyl alcohol can be added to the paper than heretofore, thereby increasing the strength of the paper.

It will thus be seen that the process of the present invention will enable improved paper to be produced. For example, low-grade paper can have its strength increased by the use of addition of partially hydrolysed anionic polyvinyl alcohol thereto. Moreover, the thickness of previously produced paper can be substantially reduced, since such thickness was previously utilized to give strength to the paper. Moreover, it is believed that the improved paper produced by the process of the present invention can be utilized in specific fields such as the medical field. In addition, high quality paper can be produced at lower cost than heretofore and by incorporation of suitable quantities of polyvinyl alcohol by utilizing the process of the present invention a plastic-like paper may be produced.

Whilst the above process has been described in relation to the use of anionic polyvinyl alcohol, it has been shown that other forms of ionic compounds can be provided if same have a polyhydroxy backbone.

In a preferred embodiment, the invention is the addition to the wet end of a paper making process 0.5% or more by weight of a flocculent and 2% or more by weight of a polyhydroxy high molecular weight material to the pulp substrate slurry (percentages based on weight of the pulp substrate).

Accordingly the case for anionic starch is given below.

Tests have been conducted using a cold water soluble carboxymethylated starch of commercial origin:

$$\text{Starch Chain}=R—OH+ClCH_2—CO_2Na—R—CH_2—CO_2H$$

This product has been made by the use of alkaline sodium monochloracetate reacting with a native starch, a commonly used industrial process for the manufacturer of anionic starch or cellulose The product has been taken and reacted with:

Aluminum ions

Polydadmacs

Wet Strength Resins (MF)

Polyamines

Cationic Dry Strength Agents

In all cases, no strength improvement was observed when a handsheet was made by the discovered method at neutral pH. However when the product was reacted with various cationic flocculents of both linear and structured backbones, a precipitate is formed that is gelatinous and confers strength properties to the finished handsheet when incorporated in the pump.

Tests with a monophosphate starch showed a similar reactivity with the cationic polymers.

Various properties were investigated, a sample of results obtained are detailed below.

These are not given as limiting examples but as a guide to the possible effects achievable by this method.

(1) Insolubilization to Remove the Starch and Associated COD from Waste Water

A sample solution containing 1,000 ppm of the starch was titrated with increasing amounts of cationic flocculent, at each stage the filtered liquid was subjected to COD examination. Results showed an initial COD of 1074 ppm reducing linearly to 70 ppm by addition of flocculent. The curve has an inversion at the point of complete precipitation followed by an increase in COD as excess flocculent is added. This shows the suitability of the method for removing excess COD from the effluent of a paper mill using this process for strengthening.

(2) Dry Strength Improvements

Tests were conducted using a spectrophotometer to measure the increase in turbidity by the addition of flocculent to test solution of starch. The maximum insolubilization appears to be at a ratio of approximately 4 parts starch to 1 part of flocculent. This will vary with the individual starch and flocculent. Tests have been conducted on the preparation of handsheets using both virgin and recycled paper including fillers in the sheet, and in all cases strength improvements were observed. It does not matter as to the order of addition of the reagents except in so much as this affects the formation of the sheet.

In a typical run using soft wood, kraft bleach pulp, a common stock was treated with 1% starch by weight of fiber. Increasing volumes of precipitating flocculent were added with stirring. In these cases the flocculent was added to the stock but it can be reacted with the starch prior to addition to the stock. The results obtained were as follows: Handsheets were made to approximately 0.65 grams in a sheet maker, 4 sheets per tests, 4 burst per sheet and the results averaged back to a 0.65 gram sheet. All tests reported are based on this test methodology.

SOFTWOOD BLEACHED KRAFT PULP (VIRGIN)

| Test at 1% Starch in Stock | Burst kpa |
|---|---|
| Blank | 59.8 |
| 27 mls flocculent 0.05% | 80.8 |
| 37 mls of flocculent 0.05% | 87.3 |
| 47 mls flocculent 0.05% | 107.3 |

Additional increases in flocculent did not increase the strength any further i.e.; all the starch available is precipitated in a useful form.

The process was tested on recycled newsprint de-ink stock taken from a local manufacturer.

Results

Using various amounts of starch and theoretical insolubilization maximum.

| Test % Starch in Stock | Burst kpa |
|---|---|
| Blank | 39.7 |
| 1% starch | 44.4 |
| 1.5% starch | 45.8 |
| 2% starch | 46.9 |

Additionally recycled broke from a quality whites mill was taken and subjected to the same test. The sheet contained approximately 15% ash:

| Test | Burst kpa | Ash |
|---|---|---|
| Blank | 17.4 | 16% |
| 1% starch | 25.3 | 14% |
| 2% starch | 30.2 | 14% |

Again the increase in strength is large and reproducible.

The results obtained above are unexpected in so much as it appears that conventional cationic coagulant materials do not precipitate these polymers in a suitable form to produce dry strength whilst cationic flocculents do so.

The economic importance of the invention is that raw starch may be anionized simply and cheaply either at a producer works or locally in the paper mill and be readily applied as a liquid product to the paper machine as the crude reaction product. This means that a very low cost strength additive can be utilized that no only confers strength but by suitable modification of the backbone could produce sizing or any other property that may be achieved by the addition of modified starches eg; pick resistance, oil resistance, scuff resistance etc. Additionally the product may be dried and sold as a cold water soluble starch or as a cookable starch to prepare on site.

It will be seen that a process has been discovered that will enable material which has been functionalized by the addition of ionic side chains thereto to be applied to a substrate and retained thereon or therein, by reacting such material with an oppositely charged material to insolubilize same. Whilst the process of the present invention has particular application to paper making, and to the use of anionic polyvinyl alcohol or anionic starch having a pendant carboxylate moiety attached thereto, which is reacted with a cationic flocculent, it is to be understood that the process may be utilized with any suitable ionic material which requires to insolubilize for application to a substrate. In particular, in relation to the paper making field, the process is utilizable with partially or fully hydrolysed functionalized polyvinyl alcohols of varying molecular weights, as well as to other polymeric materials having a polyhydroxy backbone such as starch.

Other methods of the application include:

A) A solution of the anionic high molecular weight polymer, such as starch or other suitable material, is mixed with the substrate to be reinforced. Appropriate cationic material is then added thereto and stirring is effected in order to maintain intimate mixing and precipitation. Thereafter, excess water is drained off, the product is formed to the desired shape and then dried. Dependent upon the added amount of material and the substrate properties, it is possible to achieve the following properties in the product by varying the added percentage of the gel, viz. increased tensile, burst, Z-direction strength, wet strength and sizing. Such properties are obtained by paper fiber or mineral fiber.

B) The two reacting solutions are mixed together to produce the gel and then an appropriate matrix is impregnated with the gel. Such procedure could be accomplished by individual or mixing sprays of the components. Thus, such process could be used as a coating resin type application to preformed materials.

C) A matrix is impregnated with one of the solutions and is thereafter back impregnated with the other reactant. Such procedure emulates a setting resin type of material which would operate in a similar material to two pack epoxy resins.

It is understood that variations and modifications can be effected in respect of the materials referred to above to achieve the same result whereby material, in insolubilized form can be added to a substrate eg; substrates such as non-woven materials, mineral fibers and ceiling tiles can be utilized.

Additionally it has been noted that wet strength is produced in papers treated at 4% anionized starch addition in excess of 10% of Dry Strength. Dry Strength at this dose was extremely high. Also it is believed that the precipated gel from the reaction can be removed and processed by spinning or extrusion to give a super absorbent material that will have very high water (liquid) retention ability. Uses in such products as diapers, personal hygiene or bandages are envisaged.

Furthermore, it is also possible to use amphoteric materials, eg; amphoteric starch, at suitable pH. The moiety must be ionised.

In another aspect, the present invention relates to a method to increase the strength of paper by adding components to the wet end of the paper making process. In this embodiment of the invention, a cationic starches added at a level below the neutralisation point of the substrate slurry. Thereafter, an anionic starch which is a swollen, but not cooked, is added. Swollen starch refers to starch which has not been solubilized by the cooking. For example, a naturalised potato starch will swell by accepting the water when heated at below about 65° C. allowing the starch to solubilize. Addition of the swollen starch is preferable over addition of a cooked anionic starch because as the slurry passes over the wire to form the wet paper, the starch will not be as sticky as if cooked starch had been used. Then when the wet paper reaches the finishing rollers, which drive out excess water with heat and pressure, the paper will not stick to the rollers. The pressure and heat of the rollers will cause the swollen starch to cook and burst, thereby strengthening the paper without becoming sticky so as to adhere to the rollers.

The swollen starch added should have some degree of anionicity. The starch added should have a Pka which is greater than the pH of the substrate slurry.

After addition of the swollen starch a cationic polymer as described above is added in an amount needed to neutralise the anionicity of the substrate slurry. This will then cause the previously added starch to flocculate upon the substrate slurry in greater amounts than heretofore known. The amount of cationic polymer added should be in an amount necessary to neutralise 0% of the charge of the slurry and equal to or less than an amount which neutralises the charge of the slurry.

I claim:

1. A process of improving the strength of paper produced in a paper making machine in which, at the wet end of such paper making process containing a slurry of paper pulp, an anionic polymer capable of hydrogen bonding and a cationic polymer flocculent are added, comprising first the addition of a cationic polymer capable of insolubilising a later added anionic polymer capable of hydrogen bonding, said cationic polymer is added to a charged slurry of paper pulp in an amount equal to or less than the amount needed to neutralize the anionic charge of the slurry components;

thereafter the addition an anionic polymer capable of hydrogen bonding with the substrate said anionic polymer being added in a predetermined amount to the slurry such that the amount of anionic polymer added to the amount of cationic polymer added is between 75% to 125% of the reaction ratio between the anionic polymer and cationic polymer; and forming paper from the resulting slurry.

2. A process as claimed in claim 1, in which the anionic polymer is added in an amount less than 125% of the reaction ratio amount, said reaction ratio amount being the amount of anionic polymer per unit of cationic polymer at which the amount of anionic polymer to cationic polymer is equal to the reaction ratio.

3. A process as claimed in claim 2 in which said anionic polymer is selected from the group comprising an oxidized starch, phosphate starch, carboxymethylated starch, anionic polyvinyl alcohol, carboxymethyl cellulose, xantham gums or dextran gums.

4. A process as claimed in claim 1 in which said cationic polymer is selected from the group consisting of a polyacrylamide cationic copolymers, where said cationic moiety is permanently quaternized nitrogen function, copolymerized acylamide/diallyldimethyl ammonium chloride, mannich acrylamides, a high molecular weight cationic polymer, a copolymer carrying permanently quaternised nitrogen, cationic starch, or cationic polyvinyl alcohol.

5. A process as claimed in claim 1 in which the cationic polymer is added to the slurry and thoroughly admixed therewith, prior to the addition of the anionic starch.

6. A method as claimed in claim 5 in which said cationic polymer is added in an amount sufficient to neutralize 10% or more of the charge of the slurry, and less than or equal to the amount necessary to completely neutralize the charge of the slurry.

7. A process as claimed in claim 1 in which the cationic polymer utilised is a polyhydroxide polymer or an acrylamide polymer.

8. A process as claimed in claim 1 in which the cationic polymer has a molecular weight of above 150,000.

9. A method as claimed in claim 8 in which said cationic polymer is added in an amount sufficient to neutralize 10% or more of the charge of the slurry, and less than or equal to the amount necessary to completely neutralize the charge of the slurry.

10. A process as claimed in claim 9 in which said anionic polymer is selected from the group comprising an oxidized starch, phosphate starch, carboxymethylated starch, polyvinyl alcohol, carboxvmethyl cellulose, xantham gums or dextran gums.

11. A process as claimed in claim 8 in which said anionic polymer is selected from the group comprising an oxidized starch, phosphate starch, carboxymethylated starch, polyvinyl alcohol, carboxymethyl cellulose, xantham gums or dextran gums.

12. A process as claimed in claim 1 in which said anionic polymer is selected from the group comprising an oxidized starch, phosphate starch, carboxymethylated starch, polyvinyl alcohol, carboxymethyl cellulose, xantham gums or dextran gums.

13. A process as claimed in claim 1 in which the cationic polymer has a molecular weight of above 150,000.

14. A method as claimed in claim 1 in which the cationic polymer is added in an amount sufficient to neutralise 10% or more of the charge of the slurry, and less than or equal to the amount necessary to completely neutralise the charge of the slurry.

15. A process as claimed in claim 1 in which the anionic starch is oxidised starch, phosphate starch or carboxymethylated starch.

16. A process for making paper comprising firstly forming a charged slurry of paper pulp substrate, adding a cationic polymer to the slurry, said polymer having a molecular weight of 150,000 or more in an amount sufficient to neutralize at least 10% of the charge of said slurry, but not in excess of the amount needed to neutralize the charge of the slurry, and thereafter adding an anionic polymer capable of hydrogen bonding in an amount of from 75% to 125% of a reaction ratio amount between the cationic polymer and the anionic polymer, and finally making paper from the modified slurry.

17. A process as claimed in claim 16 in which said cationic polymer is selecting from the group consisting of a polyacrylamide cationic copolymers, where said cationic moiety is permanently quaternized nitrogen function, copolymerized acrylamide/diallyldimethyl ammonium chloride, mannich acrylamides, a high molecular weight cationic polymer, a copolymer carrying permanently quaternised nitrogen, cationic starch, or polyvinyl alcohol.

18. A process as claimed in claim 16 in which said cationic polymer utilized is a polyhydroxide polymer or an acrylamide polymer.

19. A process as claimed in claim 18 in which said cationic polymer has a molecular weight of above 150,000.

20. A process as claimed in claim 16 in which said cationic polymer has a molecular weight of above 150,000.

21. A process as claimed in claim 16 in which said anionic polymer is selected from the group comprising an oxidized starch, phosphate starch, carboxymethylated starch, anionic polyvinyl alcohol, carboxymethyl cellulose, xantham gums or dextran gums.

22. A process for improving the strength of paper produced from a slurry comprising:

a) forming a charged slurry of a paper pulp substrate;

b) adding cationic polymer in an amount less than that necessary to neutralize the charge of the slurry;

c) adding a swollen cationic starch;

d) adding an anionic polymer in an amount of 1 to 20 kg per ton to cause flocculation and wherein the amount of said anionic polymer added to the amount of said cationic polymer added is between 75% to 125% of the reaction ration between said anionic polymer and said cationic polymer;

e) adding a cationic polymer;

f) subjecting the slurry to a shear force sufficient to break the resulting flocculation; and g) subsequently draining the slurry and forming paper.

23. A method as claimed in claim 22 in which said cationic polymer is added in an amount sufficient to neutralize 10% or more of the charge of the slurry, and less than or equal to the amount necessary to completely neutralize the charge of the slurry.

24. A process as claimed in claim 22 in which said anionic polymer is selected from the group comprising an oxidized starch, phosphate starch, carboxymethylated starch, anionic polyvinyl alcohol, carboxymethyl cellulose, xantham gums or dextran gums.

25. A process of improving the strength of paper produced in a paper making machine in which, at the wet end of such paper making process containing a slurry of paper pulp, an anionic polymer capable of hydrogen bonding and a cationic polymer flocculent are added, comprising first the addition of a cationic polymer capable of insolubilising a later added anionic polymer capable of hydrogen bonding which is added to a charged slurry of paper pulp in an amount equal to or less than the amount needed to neutralize the anionic charge of the slurry components;

thereafter the addition an anionic polymer capable of hydrogen bonding with the substrate, in amount between 75% to 125% of the reaction ratio between said anionic polymer and said cationic polymer, in which said anionic polymer is selected from the group comprising polyvinyl alcohol, starch, carboxymethyl cellulose, xanthan gum, or dextran gums; and forming paper from the resulting slurry.

26. The process of claim 25 wherein said cationic polymer is an acrylamide.

27. The process for improving the strength or paper produced from a slurry comprising:

forming a charged slurry of a paper substrate;

adding a cationic polymer in an amount which equal to or less than the amount needed to neutralize the change of said slurry;

adding an anionic polymer capable of hydrogen bonding with said substrate in an amount which is between 75% to 125% of the reaction ratio amount between said cationic polymer and anionic polymer; wherein said anionic polymer is a carboxyl methyl cellulose; and forming a paper from the slurry.

* * * * *